US012660890B2

(12) United States Patent
Suska et al.

(10) Patent No.: US 12,660,890 B2
(45) Date of Patent: Jun. 23, 2026

(54) HAPTIC SYSTEM FOR FOOTWEAR ARTICLE

(71) Applicant: HONEYWELL SAFETY PRODUCTS USA, INC., Charlotte, NC (US)

(72) Inventors: Juraj Suska, Brno (CZ); Dimitris Plessas, Brno (CZ)

(73) Assignee: Honeywell Safety Products USA, Inc., Latham, NY (US)

( * ) Notice: Subject to any disclaimer, the term of this patent is extended or adjusted under 35 U.S.C. 154(b) by 15 days.

(21) Appl. No.: 17/648,272

(22) Filed: Jan. 18, 2022

(65) Prior Publication Data

US 2023/0225459 A1 Jul. 20, 2023

(51) Int. Cl.
*A43C 19/00* (2006.01)
*A43B 7/20* (2006.01)

(52) U.S. Cl.
CPC ..... *A43C 19/00* (2013.01); *A43B 7/20* (2013.01)

(58) Field of Classification Search
CPC ..... A43C 19/00; A43B 3/0036; A43B 3/0094; A43B 3/02; A43B 5/002; A43B 5/0401; A43B 5/145; A43B 23/02
See application file for complete search history.

(56) References Cited

U.S. PATENT DOCUMENTS 185,797 A * 12/1876 Stribley ..... A43B 23/02 36/47
203,439 A * 5/1878 Gibson ..... A43B 23/02 36/47
203,677 A * 5/1878 Vitall ..... A43B 23/02 36/47
5,933,986 A * 8/1999 Donnadieu ..... A43B 5/0427 36/89
8,141,276 B2 * 3/2012 Ellis ..... A43B 7/24 36/103
10,893,719 B2 1/2021 Shin et al.
2006/0277787 A1 * 12/2006 Vattes ..... A43B 7/085 36/3 A
2007/0266598 A1 * 11/2007 Pawlus ..... A43B 13/16 36/76 R
2013/0247418 A1 * 9/2013 Nurse ..... A43B 13/145 36/103
2014/0230278 A1 * 8/2014 Schafer Mathison ..... A43B 1/0081 36/89

(Continued)

*Primary Examiner* — Katharine G Kane
(74) *Attorney, Agent, or Firm* — Fredrikson & Byron, P.A.

(57) ABSTRACT

Various embodiments are directed to a haptic system for promoting identification of an alignment of a pair of footwear articles relative to at least one foot of a user, the haptic system comprising: a pair of footwear articles comprising a first footwear article and a second footwear article structured to be worn on a first foot and a second foot, respectively, of a user, one or more of the first and second footwear articles comprising: a footwear article body and a collar provided along a top portion of the footwear article and comprising an inner collar portion extending along an inner body portion of the footwear article body and an outer collar portion extending along an outer body portion of the footwear article body; and wherein an inner collar portion configuration of the inner collar portion is different than an outer collar portion configuration of the outer collar portion.

18 Claims, 5 Drawing Sheets

(56) References Cited

U.S. PATENT DOCUMENTS

| | | | | |
|---|---|---|---|---|
| 2016/0095383 | A1* | 4/2016 | Surace | A43B 23/28<br>36/93 |
| 2019/0313740 | A1* | 10/2019 | Workman | A43B 7/20 |
| 2022/0128335 | A1* | 4/2022 | Marker | A43C 19/00 |

* cited by examiner

HAPTIC SYSTEM FOR FOOTWEAR ARTICLE

FIELD OF THE INVENTION

Various embodiments described herein relate generally to footwear. In particular, various embodiments are directed to haptic systems for promoting identification of an alignment of a pair of footwear articles relative to at least one foot of a user.

BACKGROUND

Various applications may require the use of one or more footwear articles configured to be worn on the feet of a user. In particular, a pair of footwear articles may include a left-foot footwear article and a right-foot footwear article that may be worn by a user on the user's left foot and right foot, respectively. Through applied effort, ingenuity, and innovation, Applicant has solved problems relating to footwear articles by developing solutions embodied in the present disclosure, which are described in detail below.

BRIEF SUMMARY

Various embodiments are directed to a haptic system for promoting identification of an alignment of a pair of footwear articles relative to at least one foot of a user and method of using the same. In various embodiments, a haptic system for promoting identification of an alignment of a pair of footwear articles relative to at least one foot of a wearer may comprise A haptic system for promoting identification of an alignment of a pair of footwear articles relative to at least one foot of a user, the haptic system comprising: a pair of footwear articles comprising a first footwear article and a second footwear article structured to be worn on a first foot and a second foot, respectively, of a user, at least one of the first footwear article and the second footwear article comprising: a footwear article body defining a footwear article interior portion therein that is configured for receiving one of the first foot or the second foot of the user via a foot opening; and a collar provided along a top portion of the footwear article so as to define at least a portion of an outer perimeter of the foot opening, the collar comprising an inner collar portion extending along an inner body portion of the footwear article body and an outer collar portion extending along an outer body portion of the footwear article body; wherein the inner collar portion is defined by an inner collar portion configuration and the outer collar portion is defined by an outer collar portion configuration; and wherein the inner collar portion configuration is at least substantially different than the outer collar portion configuration.

In various embodiments, the inner collar portion configuration may be defined at least in part by: an inner collar portion length extending between a first inner collar portion end provided at a front side of the top portion of the footwear article body and a second inner collar portion end provided at a rear side of the top portion of the footwear article body, as measured along a length axis extending linearly therebetween; and an inner collar portion profile comprising a vertical curvature defined at least partially in an upward vertical direction such that an inner collar portion peak defined by a maximum height of the inner collar portion is arranged along the inner collar portion length between the first inner collar portion end and the second inner collar portion end, the inner collar portion peak being disposed at least substantially above the length axis of the inner collar portion, as measured in a vertical direction.

In various embodiments, the vertical curvature of the inner collar portion profile may at least partially correspond to a palm curvature of a hand of the user. In various embodiments, the inner collar portion profile may comprise a radius of curvature between 30.0 mm and 300.0 mm. In various embodiments, the outer collar portion profile may comprise an at least substantially flat configuration. In various embodiments, the outer collar portion profile may comprise a second vertical curvature defined at least partially in a downward vertical direction such that an outer collar portion depth defined by a minimum height of the outer collar portion is arranged along an outer collar portion length between a first outer collar portion end and a second outer collar portion end, the outer collar portion depth being disposed at least substantially below an outer length axis of the outer collar portion, as measured in the vertical direction.

In various embodiments, the first footwear article may comprise a first collar including a first inner collar portion and a first outer collar portion and the second footwear article comprises a second collar including a second inner collar portion and a second outer collar portion; wherein the first inner collar portion is defined by a first inner collar portion configuration and the first outer collar portion is defined by a first outer collar portion configuration, the first inner collar portion being at least substantially different than the first outer portion configuration; and wherein the second inner collar portion is defined by a second inner collar portion configuration and the second outer collar portion is defined by a second outer collar portion configuration, the second inner collar portion being at least substantially different than the second outer portion configuration. In certain embodiments, the first inner collar portion configuration of the first collar may comprise an at least substantially mirrored configuration relative to the second inner collar portion configuration of the second collar. In certain embodiments, the first inner collar portion configuration of the first inner collar portion may at least partially correspond to a first palm curvature of a first hand of the user and the second inner collar portion configuration of the second inner collar portion at least partially corresponds to a second palm curvature of a second hand of the user.

In various embodiments, the inner collar portion configuration may be defined at least in part by an inner collar portion height and the outer collar portion configuration is defined at least in part by an outer collar portion height, wherein the inner collar portion height is at least substantially different than the outer collar portion height. In various embodiments, a collar height difference between the inner collar portion height and the outer collar portion height may be between 8 mm and 30 cm. In various embodiments, the inner collar portion configuration may be defined at least in part by an inner collar portion length and the outer collar portion configuration is defined at least in part by an outer collar portion length, wherein the inner collar portion length is at least substantially different than the outer collar portion length. In certain embodiments, the inner collar portion length may be between 35 mm and 100 mm. In various embodiments, the inner collar portion configuration and the outer collar portion configuration may each be defined by a respective collar portion length, a respective collar portion profile, and a respective collar portion height; wherein at least two of the respective collar portion lengths, the respective collar portion profiles, and the respective collar portion heights of the inner collar portion configuration and the outer collar portion configuration are different from one another. In certain embodiments, each of the respective collar portion lengths, the respective collar portion profiles, and the respective collar portion heights of the inner collar portion configuration and the outer collar portion configuration may be different from one another.

Various embodiments are directed to a haptic system for promoting identification of an alignment of a pair of footwear articles relative to one another with respect to a corresponding first foot and second foot of a user, the haptic system comprising: a first footwear article and a second footwear article structured to be worn on a first foot of the user, the first footwear article comprising a first collar including a first inner collar portion and a first outer collar portion, wherein the first inner collar portion is defined by a first inner collar portion configuration and the first outer collar portion is defined by a first outer collar portion configuration; and a second footwear article structured to be worn on a second foot of the user, the second footwear article comprising a second collar including a second inner collar portion and a second outer collar portion, wherein the second inner collar portion is defined by a second inner collar portion configuration and the second outer collar portion is defined by a second outer collar portion configuration; wherein the first inner collar portion configuration of the first collar is at least substantially different than the second outer portion configuration of the second collar.

In various embodiments, the first inner collar portion configuration may be defined at least in part by: a first inner collar portion length extending between a first inner collar portion end provided at a front side of a top portion of a footwear article body and a second inner collar portion end provided at a rear side of the top portion of the footwear article body, as measured along a length axis extending linearly therebetween; and a first inner collar portion profile comprising a vertical curvature defined at least partially in an upward vertical direction such that an inner collar portion peak defined by a maximum height of the first inner collar portion is arranged along the inner collar portion length between the first inner collar portion end and the second inner collar portion end, the inner collar portion peak being disposed at least substantially above the length axis of the first inner collar portion, as measured in a vertical direction. In various embodiments, the first inner collar portion configuration of the first collar may comprise an at least substantially mirrored configuration relative to the second inner collar portion configuration of the second collar. In various embodiments, the first inner collar portion configuration and the second outer collar portion configuration may each defined by a respective collar portion length, a respective collar portion profile, and a respective collar portion height; wherein at least two of the respective collar portion lengths, the respective collar portion profiles, and the respective collar portion heights of the first inner collar portion configuration and the second outer collar portion configuration are different from one another. In various embodiments, the second outer collar portion profile may comprise a second vertical curvature defined at least partially in a downward vertical direction such that an outer collar portion depth defined by a minimum height of the outer collar portion is arranged along an outer collar portion length between a first outer collar portion end and a second outer collar portion end, the outer collar portion depth being disposed at least substantially below an outer length axis of the outer collar portion, as measured in the vertical direction.

BRIEF DESCRIPTION OF THE DRAWINGS

Reference will now be made to the accompanying drawings, which are not necessarily drawn to scale, and wherein.

DETAILED DESCRIPTION

Figure 1:
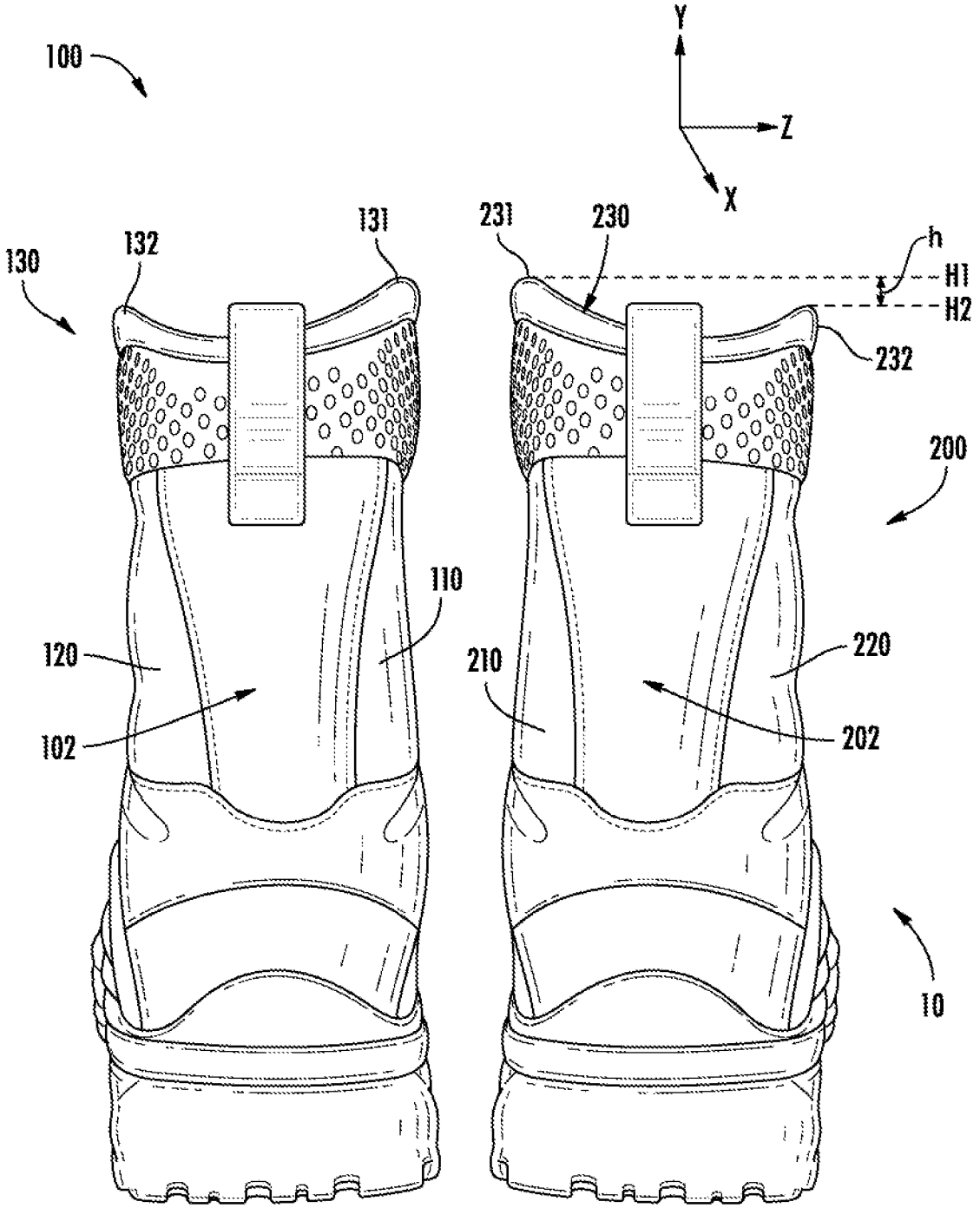
FIG. 1 illustrates a rear view of a pair of footwear articles and an exemplary haptic system according to various embodiments described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

Workers in various industries (e.g., soldiers, firefighters, relief workers, and/or the like) are may be tasked with working under time constraints that require the workers to get dressed and/or put on a pair of footwear articles in a minimal amount of time. Such temporal constraints thereby result in a need for the worker to avoid unnecessarily wasting the time by putting one or more of a pair of footwear articles on the wrong foot. Various embodiments described herein are directed to haptic systems for promoting identification of an alignment of a pair of footwear articles relative to at least one foot of a wearer. As described herein, the present invention may be configured such that, prior to the user putting on a pair of footwear articles, upon the pair of footwear articles being positioned at least substantially proximate one another in an alignment, the haptic system provided within may cause a visual indication and/or a tactile sensation in the user's hands that may function as an indicator that the pair of footwear articles (e.g., the left-foot and right-foot footwear articles), are arranged in a proper left/right alignment relative to one another. As described herein, an exemplary haptic system may be defined by at least one footwear article (e.g., of a pair of footwear articles) having a collar comprising an inner collar portion and an outer collar portion that are configured differently from one another so as to facilitate the correct identification of the footwear article by the user as a left-foot or right-foot footwear article and minimize the risk that the user will put the footwear article on the incorrect foot, such as, for example, by putting a left-foot footwear article on the user's right foot and/or putting a right-foot footwear article on the user's left foot.

The present invention promotes the immediate recognition, by a user, of a misaligned pair of footwear articles—wherein a left-foot footwear article is arranged in a position to the right of the right-foot footwear article and the right-foot footwear article is arranged in a position to the left of the left-foot footwear article (e.g., from the perspective of a user position defined by a rear-view) such that the outer sides of the left-foot and right-foot footwear articles are facing towards one another-prior to the user putting on the footwear articles. For example, as described in further detail herein, an inside collar portion of a footwear article and an outer collar portion of the footwear article may comprise at least substantially different configurations, such that, prior to the user putting on the footwear article, the user may be able distinguish, via visual identification and/or via tactile sensation, between the inner and outer sides of the footwear article. As such, the user may be able to identify, for example, that the outer sides of the respective footwear articles are facing one another and, thus, that the left-foot footwear article and right-foot footwear article are arranged in a misaligned (e.g., switched) configuration. As an illustrative example, the present invention may be defined at least in part by a footwear article comprising a collar with an inner collar portion profile that at least partially corresponds to a palm curvature of a user's hand, such that, upon the user picking up one or more of the footwear articles by the inner collar portion(s) thereof, the inner collar portion(s) of the footwear articles(s) may fit in and/or align with the palm of the user's hand such that the user experiences a tactile sensation that the user may associate with a correct fit and/or proper alignment of the pair of footwear articles relative to one or more of the user's feet. Further, as an additional illustrative example described in further detail herein, the present invention may be defined at least in part by a footwear article comprising a collar with an inner collar portion having a height that is at least substantially different than an outer collar portion height of the outer collar portion thereof, so as to enable the visual distinction, by a user, between the inner side and the outer side of a footwear article, and thus, whether the footwear article is properly aligned relative to the other footwear article of the pair to be worn by the user.

FIG. 1 illustrates a rear view of a pair of footwear articles and an exemplary haptic system according to various embodiments described herein. In particular, FIG. 1, illustrates a haptic system for promoting identification of an alignment of a pair of footwear articles relative to at least one foot of a wearer. For example, as described herein, an exemplary haptic system may be defined by at least one of a pair of footwear articles having a collar with an inner collar portion configuration and an outer collar portion configuration, wherein the inner collar portion configuration that is at least substantially different than the outer collar portion configuration. As a non-limiting example described in further detail herein, the inner collar portion configuration of the collar of the footwear article defining the haptic system may be defined by an inner collar portion profile that corresponds at least in part to a curvature of the palm of a human hand, so as to generate a haptic response with a user that facilitates a recognition of a proper left-right designation (e.g., alignment) of the footwear article upon a user engaging (e.g., grabbing) the inner collar portion of the footwear article.

In various embodiments, an exemplary pair of footwear articles may comprise a first footwear article and a second footwear article structured to be worn on a first foot and a second foot of a wearer, respectively. As illustrated in FIG. 1, an exemplary haptic system 10 may be provided at a pair of footwear articles that may comprise a first footwear article 100 comprising a left-foot footwear article structured to be worn on a left foot of a wearer and a second footwear article 200 comprising a right-foot footwear article structured to be worn on a right foot of the wearer. As non-limiting examples, in various embodiments, an exemplary footwear article may comprise a shoe, a work boot, combat boot, and/or any other footwear article comprising an at least partially structured collar. For example, using the first footwear article 100 as an exemplary footwear article embodiment for illustrative purposes, an exemplary first footwear article 100 may comprise a footwear article body that defines a footwear article interior portion therein that is configured for receiving the first foot (e.g., left foot) of the user via a first foot opening. The footwear article body of the first footwear article 100 may extend from a front footwear article end (not shown) defined along the front of the footwear article (e.g., at least substantially proximate the toe and/or tongue portion(s) thereof) to a rear footwear article end 102 defined along the back of the footwear article (e.g., at least substantially proximate a heel portion thereof). In various embodiments, the footwear article body of the first footwear article 100 may include an inner body portion 110 defined along an inner side of the first footwear article 100 (e.g., facing in an inward direction towards the second footwear article 200, as illustrated, such as, in the positive z-direction as shown in FIG. 1) and an outer body portion 120 defined along an outer side of the first footwear article 100 (e.g., facing in an outward direction away from the second footwear article 200, as illustrated, such as, in the negative z-direction as shown in FIG. 1). In various embodiments, the first footwear article may comprise a collar 130 comprising an at least partially structured element provided along a top portion of the first footwear article 100 (e.g., the footwear article body) and positioned to extend around at least a portion of the foot opening so as to define at least a portion of an outer perimeter of the foot opening. For example, the collar 130 may comprise an inner collar portion 131 extending along a top portion of the inner body portion 110 and an outer collar portion 132 extending along a top portion of the outer body portion 120. In various embodiments, the inner collar portion 131 and the outer collar portion 132 may be defined by an at least substantially continuous element (e.g., material), or, alternatively, may comprise two distinct elements positioned along the inner body portion 110 and the outer body portion 120, respectively, that are separated by a gap along the rear footwear article end 102 of the first footwear article 100. Although described herein with respect to the first footwear article 100, it should be understood that an exemplary haptic system may be at least partially defined within a second footwear article 200 (e.g., a right-foot footwear article). As shown in FIG. 1 and described above with respect to the first footwear article 100, the second footwear article 200 may comprise a footwear article body that defines a respective footwear article interior portion and foot opening, a front footwear article end (not shown), a rear footwear article end 202, an inner body portion 210, and an outer body portion 220, and may further comprise a collar 230 that comprises an inner collar portion 231 extending along a top portion of the inner body portion 210 and an outer collar portion 232 extending along a top portion of the outer body portion 220.

In various embodiments, an exemplary haptic system 10 may comprise a footwear article, such as, for exemplary illustrative purposes, first footwear article 100, comprising a collar 130 that includes an inner collar portion 131 defined by an inner collar portion configuration and an outer collar portion 132 defined by an outer collar portion configuration. Further, in various embodiments, the configuration of an exemplary collar portion (e.g., an inner collar portion 131, an outer collar portion 132) may be defined at least in part by a collar portion height, a collar portion length, and a collar portion profile. In various embodiments, as described in further detail herein in reference to FIG. 2, a collar length of an exemplary collar portion may be defined by the linear distance between a first collar portion end provided at a front side of the collar portion and a second collar portion end provided at a front side of the collar portion, as measured along a length axis extending linearly therebetween. Further, in various embodiments, a collar height of an exemplary collar portion may be defined by the linear distance between a collar portion peak of the collar portion and the linear length axis defined between the first and second collar portion ends of the collar portion. Alternatively, or additionally, the collar height of an exemplary collar portion may be defined by the linear distance between a collar portion peak of the collar portion and a supporting surface upon which the footwear article is positioned (e.g., a floor surface, a ground surface, and/or the like), as measured along a vertical axis (e.g., in the y-direction, as illustrated). Further, in various embodiments, a collar profile of an exemplary collar portion may be defined by the shape (e.g., a vertical cross-sectional configuration) of the collar portion defined along the collar portion length as the collar portion extends between the first collar portion end and the second collar portion end thereof.

In various embodiments, the inner collar portion configuration of an exemplary inner collar portion 131 may be defined at least in part by an inner collar portion height, an inner collar portion length, and an inner collar portion profile, and the outer collar portion configuration of an exemplary outer collar portion 132 of the collar 130 may be defined at least in part by an outer collar portion height, an outer collar portion length, and an outer collar portion profile. As illustrated, in various embodiments, the inner collar portion configuration and the outer collar portion configuration of an exemplary collar 130 may be at least substantially different from one another. For example, in such an exemplary circumstance, one or more of the collar portion profile, collar portion height, and collar portion length of an inner collar portion configuration of a collar 130 may be at least substantially different from a corresponding one or more of the collar portion profile, collar portion height, and collar portion length of the outer collar portion configuration of the collar 130.

For example, as illustrated in FIG. 1, the exemplary second footwear article 200 comprises a collar 230 wherein the inner collar portion configuration of the inner collar portion 231 is at least substantially different from the outer collar portion configuration of the outer collar portion 232. In particular, as shown, the inner collar portion height H1 of the inner collar portion 231 of the collar 230 is different than the outer collar portion height H2 of the outer collar portion 232 of the collar 230. For example, in various embodiments, the exemplary haptic system 10 may be defined at least in part by a vertical separation distance h between the inner collar portion height H1 and the outer collar portion height H2 of the collar 230 of a footwear article 200. As a non-limiting illustrative example, in various embodiments, the vertical separation distance h between the inner collar portion height H1 and the outer collar portion height H2 may be at least substantially between 4.0 mm and 50.0 mm (e.g., between 8.0 mm and 30.0 mm). In various embodiments, the inner collar portion length L1 of the inner collar portion 231 may be at least substantially different (e.g., at least substantially greater, at least substantially less) than an outer collar portion length of the outer collar portion of the collar 230.

Further, in various embodiments, as illustrated in FIG. 1, an exemplary haptic system 10 may be designed such that the inner collar portion configuration of the respective inner collar portions 131, 231 of the first and second footwear articles may be at least substantially the similar to one another. For example, in various embodiments, the inner collar portion profile of the inner collar portion 131 of the first footwear article 100 may define an at least substantially mirrored configuration relative to the inner collar portion profile of the inner collar portion 231 of the second footwear article 200.

Figure 2:
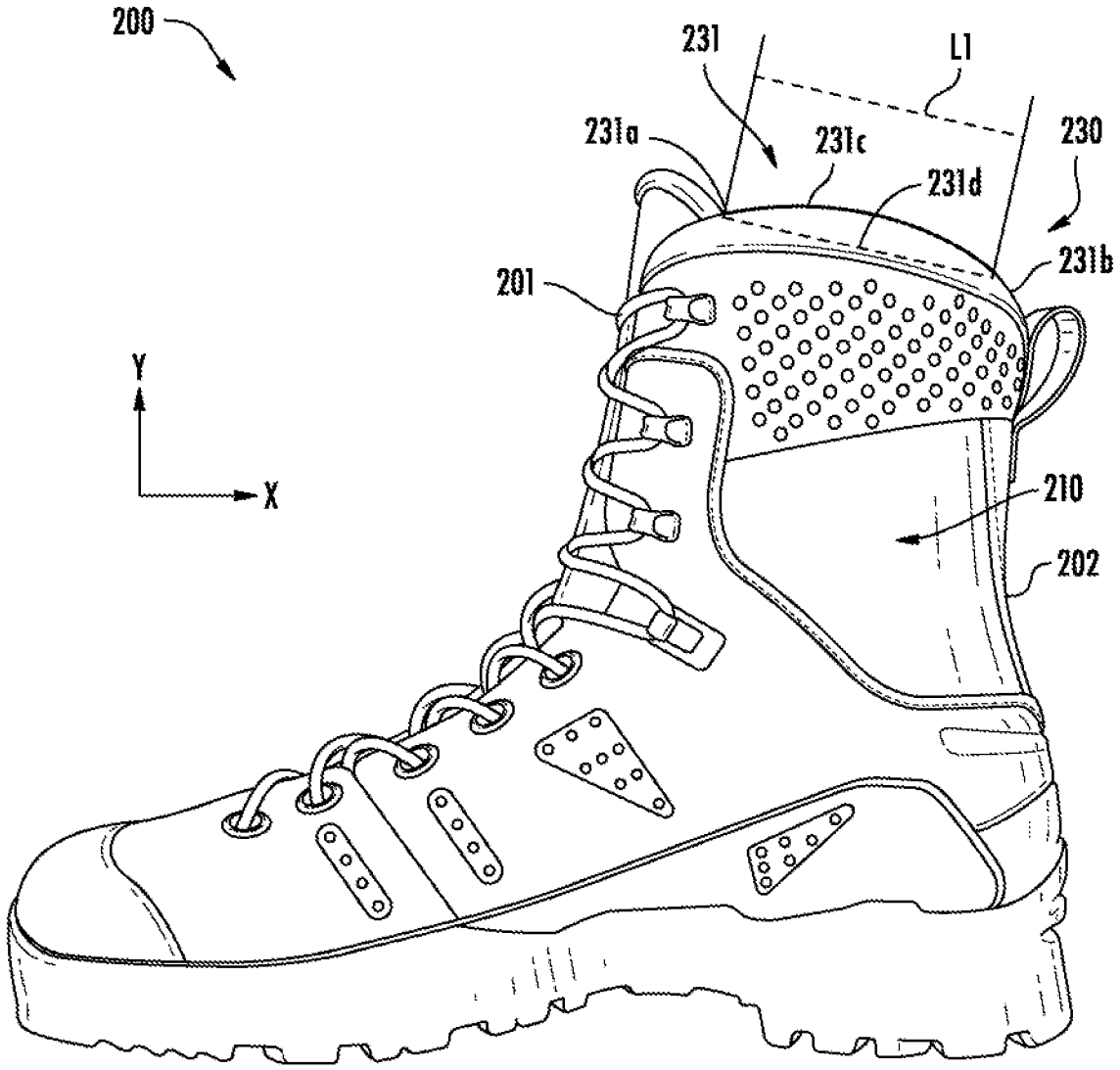
FIG. 2 illustrates a side view of a footwear article and various aspects of an exemplary haptic system according to various embodiments described herein.

FIG. 2 illustrates a side view of a footwear article and various aspects of an exemplary haptic system according to various embodiments described herein. In particular, FIG. 2 illustrates an isolated right-side perspective view of an exemplary right-foot footwear article 200 showing an inner side of the right-foot footwear article 200. As described herein, an exemplary haptic system is defined at least in part by the illustrated footwear article 200. For example, the exemplary right-foot footwear article 200 comprises a collar 230 that is defined in part by the inner collar portion 231 that extends along a top portion of the inner body portion 210, as illustrated. The inner collar portion configuration of the inner collar portion 231 is defined at least in part by the inner collar portion length, and the inner collar portion profile of the inner collar portion 231, as described herein. As illustrated in FIG. 2, the inner collar portion 231 is defined in part by an inner collar portion length L1 that comprises the linear distance between a first inner collar portion end 231*a* provided at a front side 201 of the top portion of the footwear article 200 (e.g., of the footwear article body) and a second inner collar portion end 231*b* provided at a back side 202 of the top portion of the footwear article 200, as measured along a length axis 231*d* extending linearly therebetween. As a non-limiting illustrative example, in various embodiments, an exemplary haptic system may comprise a footwear article 200 having an inner collar portion 231 with an inner collar portion length L1 of at least substantially between 30.0 mm and 100.0 mm (e.g., between 45.0 cm and 83.0 cm). In various embodiments, the inner collar portion length L1 of the inner collar portion 231 may be at least substantially different (e.g., at least substantially greater, at least substantially less) than an outer collar portion length of the outer collar portion of the collar 230.

As further illustrated in FIG. 2, an exemplary haptic system may comprise a footwear article 200 having an inner collar portion 231 defined at least in part by an at least substantially curved inner collar portion profile. For example, the inner collar portion profile may comprise a vertical curvature that is at least partially defined in an upward vertical direction (e.g., in a positive y-direction, as illustrated) such that an inner collar peak 231*c* (e.g., a maximum height of the inner collar portion 231) is disposed at least substantially above the length axis 231*d* of the inner collar portion 231, as measured in the vertical direction. In various embodiments, the inner collar portion profile of an exemplary inner collar portion 231 may comprise a vertical curvature defined by an at least substantially continuous radius of curvature. Alternatively, or additionally, in various embodiments, the inner collar portion profile of an exemplary inner collar portion 231 may comprise at least one discrete change in a radius of curvature defined along the inner collar portion 231. As a non-limiting illustrative example, in various embodiments, an exemplary haptic system may comprise a footwear article 200 having an inner collar portion 231 with an inner collar portion profile defined at least in part by a vertical curvature having a radius of curvature of at least substantially between 10.0 mm and 1000.0 mm (e.g., between 30.0 mm and 300.0 mm).

Figure 3A:
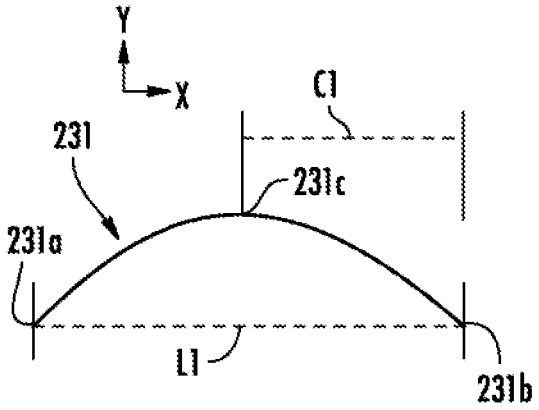
FIG. 3A-3C illustrate various schematic views of various aspects of exemplary haptic systems according to various embodiments described herein.
Figure 3B:
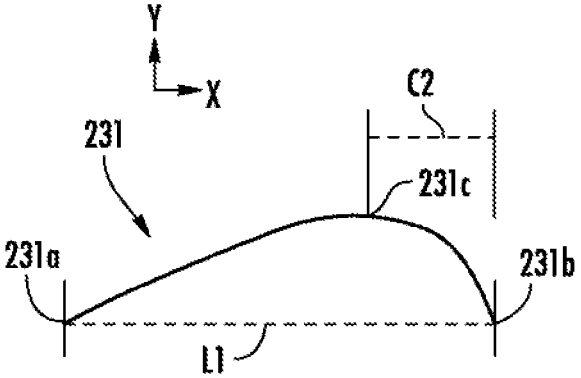
Figure 3C:
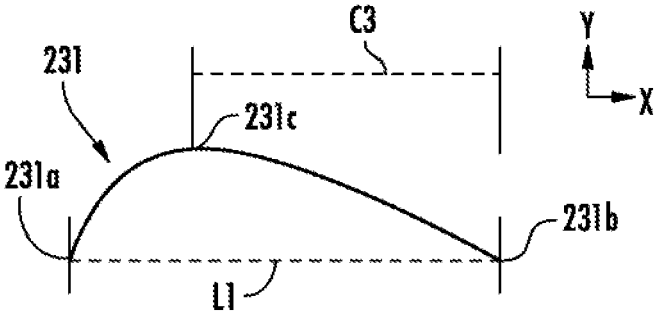

For example, as illustrated in the schematic views of various exemplary inner collar portion profiles shown in FIGS. 3A-3C, an exemplary inner collar portion may be defined by an inner collar portion profile comprising a vertical curvature that is at least partially defined in an upward vertical direction (e.g., in a positive y-direction, as illustrated) such that an inner collar peak 231*c* is disposed at least substantially above the length axis 231*d* at an inner collar peak position provided in between the first inner collar portion end 231*a* and the second inner collar portion end 231*b*. In various embodiments, as shown in FIG. 3A, the inner collar portion profile of an exemplary inner collar portion 231 may be configured such that an inner collar peak 231*c* thereof is disposed above the length axis 231*d*, as measured in the vertical direction, at an inner collar peak position that is provided at least substantially halfway between the first inner collar portion end 231*a* and the second inner collar portion end 231*b*, as measured along the length axis 231*d* (e.g., in the x-direction, as illustrated). For example, in such an exemplary configuration, the inner collar peak 231*c* of the inner collar portion 231 may be disposed at a first inner collar peak position defined by a first separation distance C1 between the inner collar peak 231*c* and the second inner collar portion end 231*b* that is at least substantially equal to 0.5*L1.

Alternatively, or additionally, in various embodiments, as shown in FIG. 3B, the inner collar portion profile of an exemplary inner collar portion 231 may be configured such that an inner collar peak 231*c* thereof is disposed above the length axis 231*d*, as measured in the vertical direction, at an inner collar peak position that is provided at least substantially closer to the second inner collar portion end 231*b* than the first inner collar portion end 231*a*, as measured along the length axis 231*d* (e.g., in the x-direction, as illustrated). For example, in such an exemplary configuration, the inner collar peak 231*c* of the inner collar portion 231 may be disposed at a second inner collar peak position defined by a second separation distance C2 between the inner collar peak 231*c* and the second inner collar portion end 231*b* that is at least substantially equal to 0.25*L1.

Alternatively, or additionally, in various embodiments, as shown in FIG. 3C, the inner collar portion profile of an exemplary inner collar portion 231 may be configured such that an inner collar peak 231*c* thereof is disposed above the length axis 231*d*, as measured in the vertical direction, at an inner collar peak position that is provided at least substantially closer to the first inner collar portion end 231*a* than the second inner collar portion end 231*b*, as measured along the length axis 231*d* (e.g., in the x-direction, as illustrated). For example, in such an exemplary configuration, the inner collar peak 231*c* of the inner collar portion 231 may be disposed at a third inner collar peak position defined by a third separation distance C3 between the inner collar peak 231*c* and the second inner collar portion end 231*b* that is at least substantially equal to 0.75*L1. As a non-limiting example, in various embodiments, the separation between the inner collar peak 231*c* and the second inner collar portion end 231*b* of an exemplary inner collar portion profile, as measured in the direction of the length axis 231*d*, may be at least approximately between 0.25 and 0.075 times the inner collar portion length L1 of the inner collar portion 231.

Figure 4B:
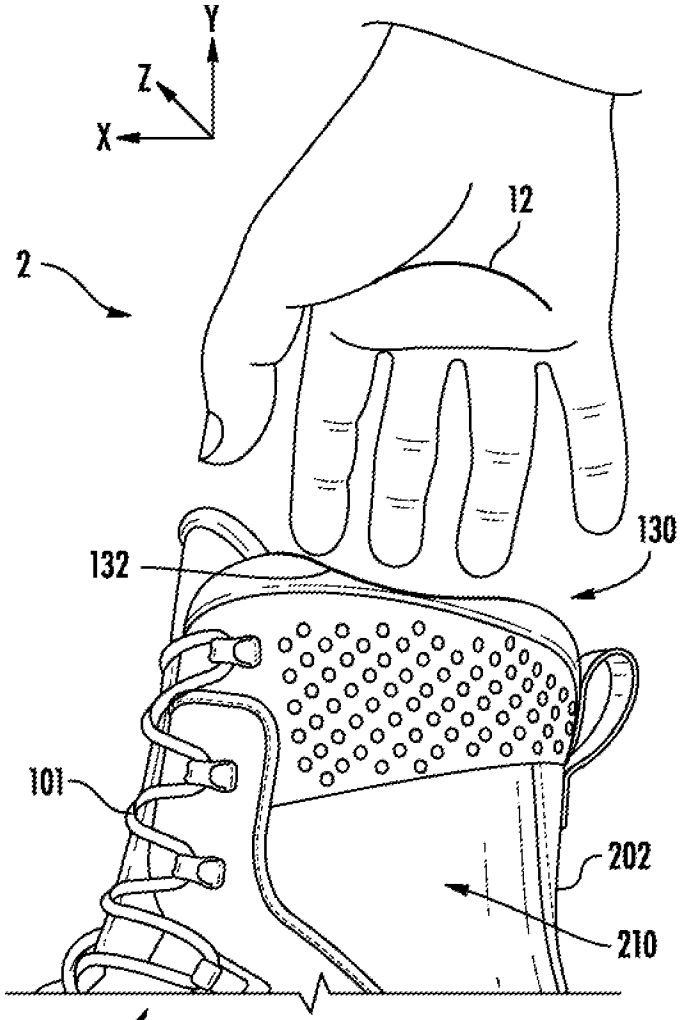
FIGS. 4A and 4B illustrate various perspective views of a footwear article and various aspects of an exemplary haptic system according to various embodiments described herein.
Figure 4A:
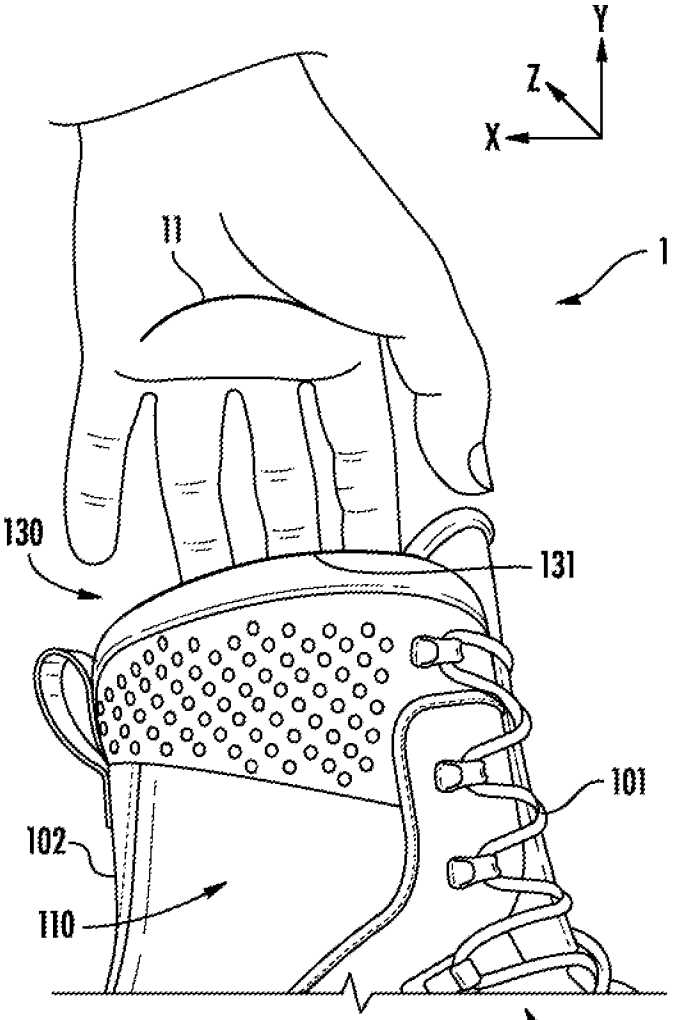

In various embodiments, as illustrated in FIG. 4A, an exemplary haptic system may be defined at least in part by an inner collar portion of a footwear article having an inner collar portion profile that corresponds to at least one curvature of a palm portion of an exemplary hand. For example, FIGS. 4A and 4B illustrate various perspective views of a footwear article and various aspects of an exemplary haptic system according to various embodiments described herein. In particular, FIG. 4A illustrates an isolated left-side perspective view of an exemplary left-foot footwear article 100 showing an inner side of the left-foot footwear article 100. As shown, a palm portion of a hand of a user, such as, for example, a user's left hand 1, may comprise at least one curvature, such as, for example, a palm curvature 11 defined by a curved ridge and/or the like extending along at least a portion of a palm of the user's hand, that may be utilized by the hand of the user to physically engage a footwear article 100 in order to pick up and/or put on the footwear article 100. In various embodiments, an inner collar portion profile of an inner collar portion 131 of an exemplary collar 130 of a left-foot footwear article 100 may be defined by a vertical curvature that at least substantially corresponds to a palm curvature 11 of an exemplary left hand 1 of a user. In such an exemplary configuration, the haptic system may be configured such that upon the left hand 1 of the user engaging the inner collar portion 131 of the left-foot footwear article 100 with a palm portion of the user's corresponding left hand 1, such as, for example, along at least a portion of the palm curvature 11 thereof in order to pick up and/or put on the left-foot footwear article 100, the inner collar portion profile of the inner collar portion 131 may at least substantially fit into and/or align with the palm curvature 11 of the left hand 1 of the user so as to provide a tactile sensation to the user that may be indicative of a proper left/right alignment of the left-foot footwear article 100.

Conversely, such an exemplary haptic system may be defined at least in part by a footwear article 100 comprising a collar 130 having an outer collar portion 132 defined by an outer collar portion profile that is at least substantially different than the inner collar portion profile of the inner collar portion of the collar 130, such that the outer collar portion profile is defined by a shape that is at least substantially different than the palm curvature 11 of the left hand 1 of the user. For example, as illustrated in FIG. 4B, illustrates an isolated right-side perspective view of an exemplary left-foot footwear article 100 showing an outer side of the left-foot footwear article 100. As shown, a palm portion of a right hand 2 of a user may comprise a palm curvature 12 defined by a curved ridge and/or the like extending along at least a portion of a palm of the user's right hand 2 that may be utilized to physically engage a footwear article 100 in order to pick up and/or put on the footwear article 100. In various embodiments, the outer collar portion profile of the outer collar portion 132 of the collar 130, as described herein, may be defined by a curvature, geometry, shape, and/or the like that is at least substantially different than a palm curvature of an exemplary hand. For example, in such an exemplary configuration, the haptic system may be configured such that upon a user engaging the outer collar portion 132 of a left-foot footwear article 100 with a palm portion of the user's corresponding hand (e.g., the user's righthand 2, as illustrated) 1, such as, for example, in order to pick up and/or put on the left-foot footwear article 100, at least a portion of the outer collar portion profile of the outer collar portion 132 may remain a distance away from the palm curvature 12 of the user's hand 2 such that the outer collar portion 132 fails to fit into and/or align with the palm portion of the user's hand 2. Accordingly, the unamicable fit between the outer collar portion 132 and the palm curvature 12 of the user's hand 2 may provide a tactile sensation to the user that may be indicative of an improper left/right alignment of the left-foot footwear article 100 (e.g., an alignment of the left-foot footwear article 100 on a right and/or outer side of a right-foot footwear article such that the left-foot footwear article appears to correspond to the right-foot of a user, and thus, promote the engagement of the left-foot footwear article 100 by the right hand 2 of the user).

Figure 5B:
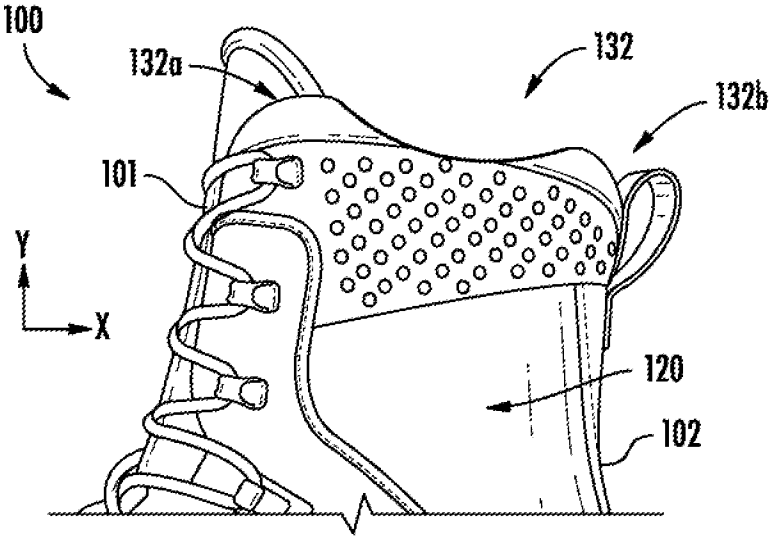
FIGS. 5A-5C illustrate various side views of a footwear article and various aspects of an exemplary haptic system according to various embodiments described herein.
Figure 5A:
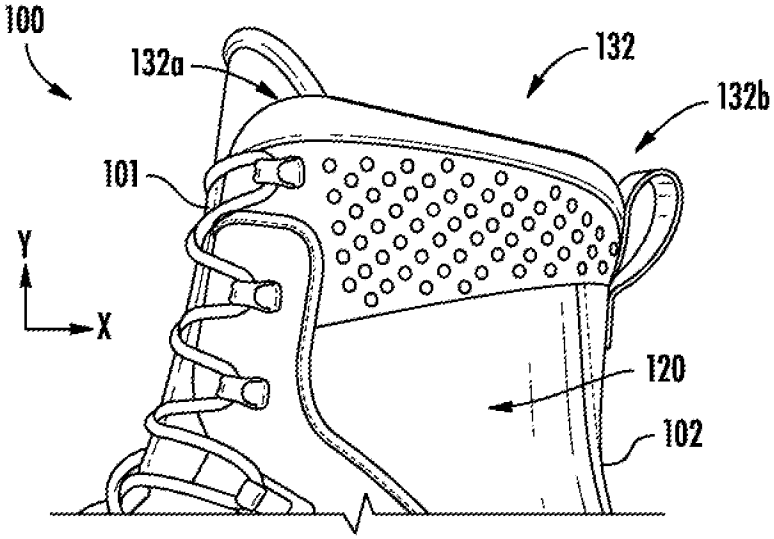
Figure 5C:
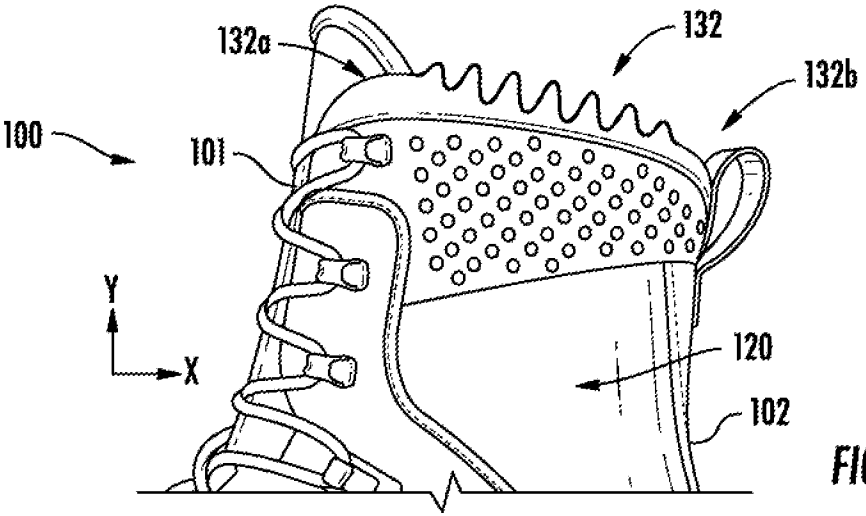

For example, FIGS. 5A-5C illustrate various perspective views of a footwear article and various aspects of an exemplary haptic system according to various embodiments described herein. In particular, FIGS. 5A-5C illustrate various isolated right-side perspective views of exemplary left-foot footwear articles 100 showing an outer side of the left-foot footwear article 100. As illustrated, in various embodiments, the outer collar portion profile of the outer collar portion 132 may be configured such that a curvature, geometry, and/or shape thereof is that is at least substantially different than that of the palm curvature of an exemplary user's hand. For example, as illustrated in FIG. 5A, the outer collar portion profile may have an at least substantially flat profile, such as, for example, a profile having an at least substantially zero-curvature in the vertical direction. As shown, the outer collar portion profile of the outer collar portion 132 may comprise an at least substantially linear portion that extends between the first outer collar portion end 132*a* and the second outer collar portion end 132*b* in a direction that is at least substantially parallel to the length axis 132*c* defined therebetween. Alternatively, or additionally, in various embodiments, as shown in FIG. 5B, the outer collar portion 132 may be defined by an outer collar portion profile comprising a vertical curvature defined at least partially in a downward vertical direction such that an outer collar portion depth defined by a minimum height of the outer collar portion is arranged along an outer collar portion length between a first outer collar portion end 132*a* and a second outer collar portion end 132*b*. In such an exemplary configuration, the outer collar portion depth may be disposed at least substantially below an outer length axis of the outer collar portion, as measured in the vertical direction. For example, in various embodiments wherein the outer collar portion 132 is defined by an outer collar portion profile comprising a vertical curvature defined at least partially in a downward vertical direction, as illustrated in FIG. 5B, the outer collar portion profile of the outer collar portion 132 may comprise an inverse configuration relative to inner collar portion profile of the inner collar portion 131 of the exemplary collar 130. Further, alternatively, or additionally, in various embodiments, as shown in FIG. 5C, the outer collar portion 132 may be defined by an outer collar portion profile comprising an at least substantially complex profile defined by one or more discrete geometric shapes, a plurality discrete curvatures, and/or the like, or a combination thereof. For example, as illustrated in FIG. 5C, the outer collar portion profile may have an at least substantially wavy profile, such as, for example, a profile having an at least substantially sinusoidal configuration defined by a plurality of serially arranged curvatures.

As described herein, a pair of footwear articles defining a haptic footwear system may comprise a left-foot footwear article comprising a first collar with a first inner collar portion defined by an inner collar portion profile corresponding to a left-hand palm curvature of an exemplary user's left-hand, and a right-foot footwear article 200 comprising a second collar with an inner collar portion defined by a second inner collar portion profile corresponding to a right-hand palm curvature of an exemplary user's right-hand. For example, referring back to the exemplary haptic system 10 illustrated in FIG. 1, such an exemplary haptic system 10 may be provided in the left-foot footwear article 100 and the right-foot footwear article 200 such that, when the footwear articles 100, 200 are arranged in a proper left/right alignment—wherein the left-foot footwear article 100 is positioned to the left of the right-foot footwear article 200 and the right-foot footwear article 200 is positioned to the right of the left-foot footwear article 100 (e.g., from the perspective of a user position defined by a rear-view, as illustrated in FIG. 1) such that the inner sides of the left-foot and right-foot footwear articles 100, 200 are facing each other and the respective inner collar portions 131, 231 are positioned for at least substantially simultaneous engagement by a user's hand—the haptic system may cause a visual indication and/or a tactile sensation in the user's hands that may function as an indicator that the pair of footwear articles (e.g., the left-foot and right-foot footwear articles 100, 200), are arranged in a proper left/right alignment relative to one another and/or the respective left and right hands of a user. Conversely, the haptic system 10 may be configured such that the first and second outer collar portions 132, 232 of the left-foot and right-foot footwear articles 100, 200, respectively, comprise an at least substantially different collar portion configuration than the respective inner collar portions 131, 231 of the corresponding footwear articles. In such exemplary circumstances, the haptic system 10 may be configured such that, when the footwear articles 100, 200 are arranged in an improper left/right alignment—wherein the left-foot footwear article 100 is positioned to the right of the right-foot footwear article 200 and the right-foot footwear article 200 is positioned to the left of the left-foot footwear article 100 (e.g., from the perspective of a user position defined by a rear-view) such that the outer sides of the left-foot and right-foot footwear articles 100, 200 are facing each other and the respective outer collar portions 132, 232 are positioned for at least substantially simultaneous engagement by a user's hand—the haptic system may cause a visual indication and/or a tactile sensation in the user's hands that may function as an indicator that the pair of footwear articles (e.g., the left-foot and right-foot footwear articles 100, 200), are misaligned and/or arranged in an improper left/right alignment relative to one another and/or the respective left and right hands/feet of a user.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A haptic system for promoting identification of an alignment of a pair of footwear articles relative to at least one foot of a user, the haptic system comprising:

the pair of footwear articles comprising a first footwear article and a second footwear article structured to be worn on a first foot and a second foot, respectively, of the user, at least one of the first footwear article and the second footwear article comprising:

a footwear article body defining a footwear article interior portion therein that is configured for receiving one of the first foot or the second foot of the user via a foot opening; and a collar provided along a top portion of the footwear article body so as to define at least a portion of an outer perimeter of the foot opening, the collar comprising an inner collar portion extending along an inner body portion of the footwear article body and an outer collar portion extending along an outer body portion of the footwear article body;

wherein the inner collar portion is defined by an inner collar portion configuration and the outer collar portion is defined by an outer collar portion configuration, wherein the outer collar portion configuration defines a sinusoidal profile comprising a plurality of serially arranged curvatures;

wherein an inner collar portion length is extending between a first inner collar portion and a second inner collar portion;

wherein a first inner collar portion configuration of the first inner collar portion at least partially corresponds to a first palm curvature of a first hand of the user and a second inner collar portion configuration of the second inner collar portion at least partially corresponds to a second palm curvature of a second hand of the user so as to generate a haptic response to the user to differentiate the first footwear article from the second footwear article upon the user engaging the inner collar portion of one of the first footwear article and the second footwear article;

wherein an inner collar portion height of the inner collar portion is different than an outer collar portion height of the outer collar portion; and wherein the inner collar portion configuration is defined at least in part by an inner collar portion profile comprising a vertical curvature defined at least partially in an upward vertical direction from a first inner collar portion end and from a second inner collar end portion to an inner collar portion peak, the upward vertical direction extending from a sole of the footwear article body to the collar, such that the inner collar portion peak defined by a maximum height of the inner collar portion is arranged along the inner collar portion length between the first inner collar portion end and the second inner collar portion end, the inner collar portion peak being disposed at least substantially above a length axis of the inner collar portion as measured in the upward vertical direction, wherein the maximum height of the inner collar portion is a maximum linear distance between the inner collar portion peak and a supporting surface upon which the sole of the footwear article is positioned, wherein the length axis is an imaginary line extending linearly between the first inner collar portion end and the second inner collar portion end.

2. The haptic system of claim 1, wherein the inner collar portion configuration is defined at least in part by:

the inner collar portion length extending between the first inner collar portion end provided at a front side of the top portion of the footwear article body and the second inner collar portion end provided at a rear side of the top portion of the footwear article body, as measured along the length axis extending linearly therebetween.

3. The haptic system of claim 2, wherein the vertical curvature of the inner collar portion profile at least partially corresponds to a palm curvature of a hand of the user.

4. The haptic system of claim 3, wherein the inner collar portion profile comprises a radius of curvature between 30.0 mm and 300.0 mm.

5. The haptic system of claim 3, wherein an outer collar portion profile comprises an at least substantially flat configuration.

6. The haptic system of claim 3, wherein an outer collar portion profile comprises a second vertical curvature defined at least partially in a downward vertical direction such that an outer collar portion depth defined by a minimum height of the outer collar portion is arranged along an outer collar portion length between a first outer collar portion end and a second outer collar portion end, the outer collar portion depth being disposed at least substantially below an outer length axis of the outer collar portion, as measured in the upward vertical direction.

7. The haptic system of claim 1, wherein the first footwear article comprises a first collar including the first inner collar portion and a first outer collar portion and the second footwear article comprises a second collar including the second inner collar portion and a second outer collar portion; wherein the first inner collar portion is defined by the first inner collar portion configuration and the first outer collar portion is defined by a first outer collar portion configuration, the first inner collar portion being at least substantially different than the first outer collar portion configuration; and wherein the second inner collar portion is defined by the second inner collar portion configuration and the second outer collar portion is defined by a second outer collar portion configuration, the second inner collar portion being at least substantially different than the second outer collar portion configuration.

8. The haptic system of claim 7, wherein the first inner collar portion configuration of the first collar comprises an at least substantially mirrored configuration relative to the second inner collar portion configuration of the second collar.

9. The haptic system of claim 1, wherein a collar height difference between the inner collar portion height and the outer collar portion height is between 8 mm and 30 cm.

10. The haptic system of claim 1, wherein the inner collar portion configuration is defined at least in part by the inner collar portion length and the outer collar portion configuration is defined at least in part by an outer collar portion length, and wherein the inner collar portion length is at least substantially different than the outer collar portion length.

11. The haptic system of claim 10, wherein the inner collar portion length is between 35 mm and 100 mm.

12. The haptic system of claim 1, wherein the inner collar portion configuration and the outer collar portion configuration are each defined by a respective collar portion length, a respective collar portion profile, and a respective collar portion height; wherein at least two of the respective collar portion lengths, the respective collar portion profiles, and the respective collar portion heights of the inner collar portion configuration and the outer collar portion configuration are different from one another.

13. The haptic system of claim 12, wherein each of the respective collar portion lengths and the respective collar portion profiles of the inner collar portion configuration and the outer collar portion configuration are different from one another.

14. A haptic system for promoting identification of an alignment of a pair of footwear articles relative to one another with respect to a first foot and a second foot of a user, the haptic system comprising:

a first footwear article structured to be worn on the first foot of the user, the first footwear article comprising a first collar including a first inner collar portion and a first outer collar portion, wherein the first inner collar portion is defined by a first inner collar portion configuration and the first outer collar portion is defined by a first outer collar portion configuration; and a second footwear article structured to be worn on the second foot of the user, the second footwear article comprising a second collar including a second inner collar portion and a second outer collar portion, wherein the second inner collar portion is defined by a second inner collar portion configuration and the second outer collar portion is defined by a second outer collar portion configuration;

an inner collar portion length extending between the first inner collar portion and the second inner collar portion;

wherein the first inner collar portion configuration of the first inner collar portion at least partially corresponds to a first palm curvature of a first hand of the user and the second inner collar portion configuration of the second inner collar portion at least partially corresponds to a second palm curvature of a second hand of the user so as to generate a haptic response to the user to differentiate the first footwear article from the second footwear article upon the user engaging the inner collar portion of one of the first footwear article and the second footwear article;

wherein a height of the first inner collar portion is different than a height of the first outer collar portion, and wherein a height of the second inner collar portion is different than a height of the second outer collar portion; and wherein the first inner collar portion configuration is defined at least in part by a first inner collar portion profile comprising a vertical curvature defined at least partially in an upward vertical direction, the upward vertical direction being considered from a sole of the footwear article body to the collar, such that an inner collar portion peak defined by a maximum height of the first inner collar portion is arranged along the inner collar portion length between a first inner collar portion end and a second inner collar portion end, the inner collar portion peak being disposed at least substantially above a length axis of the first inner collar portion as measured in the upward vertical direction, wherein the maximum height of the inner collar portion is a maximum linear distance between the inner collar portion peak and a supporting surface upon which the sole of the footwear article is positioned, wherein the length axis is an imaginary line extending linearly between the first inner collar portion end and the second inner collar portion end, wherein each of the first outer collar configuration and the second outer collar portion configuration defines a sinusoidal profile comprising a plurality of serially arranged curvatures having a plurality of peaks and a plurality of troughs.

15. The haptic system of claim 14, wherein the first inner collar portion configuration is defined at least in part by:

a first inner collar portion length extending between the first inner collar portion end provided at a front side of a top portion of a footwear article body and the second inner collar portion end provided at a rear side of the top portion of the footwear article body, as measured along the length axis extending linearly therebetween.

16. The haptic system of claim 15, wherein the first inner collar portion configuration of the first collar comprises an at least substantially mirrored configuration relative to the second inner collar portion configuration of the second collar.

17. The haptic system of claim 16, wherein the first inner collar portion configuration and the second outer collar portion configuration are each defined by a respective collar portion length, a respective collar portion profile, and a respective collar portion height; wherein at least two of the respective collar portion lengths, the respective collar portion profiles, and the respective collar portion heights of the first inner collar portion configuration and the second outer collar portion configuration are different from one another.

18. The haptic system of claim 14, wherein a second outer collar portion profile comprises a second vertical curvature defined at least partially in a downward vertical direction such that an outer collar portion depth defined by a minimum height of an outer collar portion is arranged along an outer collar portion length between a first outer collar portion end and a second outer collar portion end, the outer collar portion depth being disposed at least substantially below an outer length axis of the outer collar portion, as measured in the upward vertical direction.

* * * * *